US006099110A

United States Patent [19]

Tani et al.

[11] Patent Number: 6,099,110

[45] Date of Patent: Aug. 8, 2000

[54] IMAGE FORMING APPARATUS

[75] Inventors: Kenji Tani, Yamatokoriyama; Yasuichi Onose, Sakurai; Kazuya Masuda; Nobuhiko Nakano, both of Nara; Shirou Wakahara, Soraku-gun, all of Japan

[73] Assignee: Sharp Kabushiki Kaisha, Osaka, Japan

[21] Appl. No.: 09/078,371

[22] Filed: May 13, 1998

[30] Foreign Application Priority Data

May 16, 1997 [JP] Japan ..... 9-127068

[51] Int. Cl.[7] ..... B41J 2/06

[52] U.S. Cl. ..... 347/55; 347/54

[58] Field of Search ..... 347/55, 54

[56] References Cited

U.S. PATENT DOCUMENTS

| | | | |
|---|---|---|---|
| 5,386,225 | 1/1995 | Shibata | 347/55 |
| 5,530,464 | 6/1996 | Hiwada | 347/55 |
| 5,633,110 | 5/1997 | Desie et al. | 347/55 X |
| 5,654,745 | 8/1997 | Luque | 347/55 |
| 5,708,464 | 1/1998 | Desie | 347/55 |
| 5,717,449 | 2/1998 | Luque | 347/55 |
| 5,781,218 | 7/1998 | Wakahara et al. | 347/55 X |
| 5,880,760 | 3/1999 | Desie et al. | 347/55 |
| 5,889,540 | 3/1999 | Leonard et al. | 347/55 |
| 5,933,176 | 8/1999 | Wakahara | 347/55 X |

FOREIGN PATENT DOCUMENTS 4-358 856 12/1992 Japan .

*Primary Examiner*—Matthew S. Smith

*Attorney, Agent, or Firm*—Dike, Bronstein, Roberts & Cushman, LLP; David G. Conlin; William J. Daley, Jr.

[57] ABSTRACT

An object of the present invention is to provide an image forming apparatus for enabling toner to easily pass through gates of control electrode and increasing the scattering efficiency of the toner to improve the printing quality. Since a sticking force between the toner and toner holder or among particles thereof is weakened and the toner is held on the toner holder with a slight binding force between the toner holder and the control electrode, a voltage applied for enabling the toner to pass through the gates of the control electrode and scatter toward the counter electrode can be minimized as long as the toner can pass through the gates of the control electrode. In other words, a pulse is applied to a shielded electrode just before the toner held on the toner holder passes through the gates of the control electrode, so that the sticking force between the toner and the toner holder or among particles thereof can be weakened, or the toner can be transformed into cloud-like particles. Accordingly, the toner can easily pass through the gates of the control electrode and the scattering efficiency of the toner is increased to improve the printing quality.

17 Claims, 8 Drawing Sheets

IMAGE FORMING APPARATUS

BACKGROUND OF THE INVENTION

1. Field of the Invention

The present invention relates to an image forming apparatus applicable to printing units of digital copying machines and facsimile machines, as well as to digital printers, plotters, or the like, and forming an image onto a recording medium by scattering a developer.

2. Description of the Related Art

There are known as image forming methods for forming visible images onto a recording medium such as paper by using electric signals outputted from a computer, a word processor, a facsimile machine, etc., an ink jet method using ink, a heat transfer method of transferring an image with fused ink, an ink sublimation method, an electrophotographic method etc.

In recent years, in order to meet demands for faster printing, higher printing quality and lower prices of printing, the ink jet method, which is one of non-impact image forming methods that allows the apparatus to be manufactured integrally with a print head in a comparatively simplified configuration, is increasingly adopted. However, since a liquid of ink is used for the ink jet method, the ink is apt to ooze out on paper and a satisfactory image is difficult to obtain. Besides, in the case of color overprinting, mixed colors made by mixing inks cannot be obtained as expected. Therefore, the electrophotographic method with toner is adopted when high quality printing is required. In printing with toner, the toner does not ooze out, and hence an image which has a thick color tone and is excellent in visual appeal can be obtained. In addition, in the case where a plurality of colors are mixed for the purpose of color printing, the colors are mixed in the fixing process and satisfactory mixed colors can be obtained. Accordingly, there is proposed a direct printing method with toner, which is a combination of simple processes of the ink jet printing method and toner images.

For example, Japanese Unexamined Patent Publication JP-A 4-358856 (1992) discloses a method for forming an image in an image forming apparatus comprising an aperture electrode unit having openings, a toner holder for feeding charged toner to the vicinity of the openings, and a counter electrode facing the aperture electrode unit, which is positioned at the opposite side of the toner holder, the method comprising modulating and controlling the toner held on the toner holder by the aperture electrode unit.

In the technology disclosed in JP-A 4-358856, the image forming apparatus is formed in such a manner that an oscillating electrical field is generated at a piezoelectric member provided so as to cover the toner holder to separate the toner from the toner holder due to the expansion/shrinkage of the piezoelectric member according to the oscillating electrical field. In this case, since the whole toner holder is vibrated, even the toner held on the toner holder in areas which are neither to be modulated nor to be controlled by the aperture electrode unit is separated from the toner holder, with the result that the toner is likely to be accumulated on the aperture electrode unit.

Further, since it is difficult to finely control the toner by vibration, it is very difficult to keep the toner between the toner holder and the aperture electrode unit without causing the toner to fall onto the aperture electrode unit. Furthermore, means for generating an oscillating electrical field at the piezoelectric member is formed to be an oscillating power supply for generating the oscillating electrical field, but it makes the circuit configuration complicated and leads the manufacturing cost of the apparatus to increase. Therefore, such a method is not favorable.

SUMMARY OF THE INVENTION

It is hence an object of the present invention to solve the conventional problems mentioned above, i.e., to provide an image forming apparatus in which a developer held on a developer holder is controlled by a pulse just before passing through gates of a control electrode, so that the status of the developer is changed in a manner that the sticking force between the developer and the developer holder or among particles thereof is weakened, or so that the developer is transformed into cloud-like particles, whereby the scattering efficiency of the developer is increased with a simple configuration and a satisfactory printing quality is obtained.

In a first aspect of the invention, an image forming apparatus comprises:

- supplying means having a holder for holding a developer for developing at least one color;
- a counter electrode disposed so as to face the holder;
- a control electrode disposed between the holder and the counter electrode, including:
  - an insulated substrate provided with a plurality of gates through which the developer passes,
  - one or more groups of electrodes disposed around the plurality of gates of the insulated substrate, and
  - a shielded electrode having openings corresponding to the plurality of gates of the insulated substrate, the shielded electrode being disposed on the insulated substrate so that a part of the groups of electrodes is exposed directly or electrically to the holder through the openings; and
- controlling means having control circuit, for applying at least a predetermined electric potential according to image data, to respective electrodes of the control electrode,
- the image forming apparatus forming an image on a surface of a recording medium fed to between the control electrode and the counter electrode while the passage of the developer through the gates is controlled by applying a predetermined electric potential to the groups of electrodes by the controlling means
- wherein, just before passing through the gates, the developer is controlled so that a change in the status of the developer is obtained such that a sticking force between the developer and the holder or among particles thereof is weakened, or that the developer is transformed into cloud-like particles.

In a second aspect of the invention, the image forming apparatus is characterized in that the status of the developer is controlled by a pulse electric potential consisting of at least a single pulse generated by the control circuit.

In a third aspect of the invention, the image forming apparatus is characterized in that the control circuit applies the pulse electric potential to the shielded electrode.

In a fourth aspect of the invention, the image forming apparatus is characterized in that, just before applying an electric potential to be applied to the electrodes disposed to the gates so as to cause the developer to pass through the gates, the control circuit applies the pulse electric potential to the electrodes.

In a fifth aspect of the invention, the image forming apparatus is characterized in that the control circuit applies the pulse electric potential to the groups of electrodes disposed to the control electrode.

In a sixth aspect of the invention, the image forming apparatus is characterized in that the control circuit applies the pulse electric potential and the electric potential applied so as to cause the developer to pass through the gates, from the same control circuit.

In a seventh aspect of the invention, the image forming apparatus is characterized in that the control circuit controls an amplitude of the pulse so that an electrical field for enabling the developer to move to the control electrode when a width of the pulse is increased enough.

In an eighth aspect of the invention, the image forming apparatus is characterized in that the control circuit controls the pulse width so as to be shorter enough than a width of time in which the developer can be moved to the control electrode due to an electrical field formed by the pulse electric potential.

In a ninth aspect of the invention, the image forming apparatus is characterized in that the control circuit supplies an impulse or a pseudo impulse to the electrode as the pulse.

In a tenth aspect of the invention, the image forming apparatus is characterized in that the strength of the electrical field given to the developer due to the electric potential applied to the groups of electrodes by the control circuit is given to the developer held in and in the vicinity of an area of the holder facing at least the gates to cause the developer to pass through due to the electric potential applied so as to cause the developer to pass through the gates, the strength of the electrical field being smaller than the strength of the electrical field necessary for the developer to pass through the gates when the developer is not changed in status.

In an eleventh aspect of the invention, an image forming apparatus comprises:

supplying means having a holder for holding a developer for developing at least one color;

a counter electrode disposed so as to face the holder;

a control electrode disposed between the holder and the counter electrode, including:

an insulated substrate provided with a plurality of gates through which the developer passes, and one or more groups of electrodes including a first group of electrodes disposed around the plurality of gates on the holder side surface of the insulated substrate and a second group of electrodes disposed around the plurality of gates on the counter electrode side surface of the insulated substrate; or an insulated substrate provided with a plurality of gates through which the developer passes, one or more groups of electrodes including a first group of electrodes disposed around the plurality of gates on the holder side surface of the insulated substrate and a second group of electrodes disposed around the plurality of gates on the counter electrode side surface of the insulated substrate, and a single plate-like shielded electrode having openings corresponding to the plurality of gates of the insulated substrate, disposed on the holder side of the insulated substrate; and controlling means having control circuit means for applying at least a predetermined electric potential according to image data to respective electrodes of the control electrode, and the image forming apparatus forming an image on a surface of a recording medium fed to between the control electrode and the counter electrode while the passage of the developer through the gates is controlled by applying a predetermined electric potential to the groups of electrodes by the controlling means wherein, just before passing through the gates, the developer is controlled so that a change in the status of the developer is obtained such that a sticking force between the developer and the holder or among particles thereof is weakened, or that the developer is transformed into cloud-like particles.

In a twelfth aspect of the invention, the image forming apparatus is characterized in that the control circuit does not control at least the groups of electrodes to which an electric potential is sequentially applied in a specified order.

In a thirteenth aspect of the invention, the image forming apparatus is characterized in that the shielded electrode is divided into a plurality of parts at least in accordance with a distance from the holder or from the developer held on the holder surface, and the control circuit applies a pulse or impulse having a different peak value in accordance with the distance to each of the electrodes to control a degree of change in status of the developer, whereby an image uniform or in a desired status is formed onto the recording medium surface.

In a fourteenth aspect of the invention, the image forming apparatus is characterized in that the shielded electrode is divided into a plurality of parts at least in accordance with a distance from the holder or from the developer held on the holder surface, and the control circuit applies a pulse or impulse having a different pulse width in accordance with the distance to each of the electrodes to control a degree of change in status of the developer, whereby an image uniform or in a desired status is formed onto the recording medium surface.

In a fifteenth aspect of the invention, the image forming apparatus is characterized in that when a distance between an electrode to which the pulse or impulse is to be applied and the holder or the developer held on the holder may be different with reference to an arbitrary electrode, the pulse or impulse having a different peak value in accordance with the distance is applied to each of the electrodes to control a degree of change in status of the developer, whereby an image is formed onto the recording medium surface in a uniform or a desired status.

In a sixteenth aspect of the invention, the image forming apparatus is characterized in that when a distance between an electrode to which the pulse or impulse is to be applied and the holder or the developer held on the holder may be different with reference to an arbitrary electrode, the pulse or impulse having a different pulse width in accordance with the distance is applied to each of the electrodes to control a degree of change in status of the developer, whereby an image uniform or in a desired status is formed onto the recording medium surface.

According to the image forming apparatus of the invention, just before passing through the gates of the control electrode, the developer held on the holder is controlled so that the status thereof is changed in such a manner that the sticking force between the developer and the holder or among particles thereof is weakened, or that the developer is transformed into cloud-like particles, whereby the status of the developer can be changed only in a proper amount of the developer held on the holder. Further, since the status of the developer is controlled by a pulse electric potential consisting of at least a single pulse generated by the control circuit of the control electrode, such a complicated configuration as oscillating means is not required as well as a subtle movement of the developer can be controlled by controlling the pulses. Accordingly, the developer can be held between the holder and the control electrode. In addition, the developer is controlled so that the status thereof is changed in a manner that the sticking force between the developer and the holder or among particles thereof is weakened, or that the developer is transformed into cloud-like particles, whereby an electric potential to be applied to the gates of the control electrode for causing the developer to scatter toward the counter electrode can be lowered. Furthermore, the pulse electric potential and the electric potential applied to the gates for causing the toner to scatter toward the counter electrode are applied from the same control circuit, so that a plurality of control circuits are not necessary. Thus, the control circuit can be configured in a compact form as well as the manufacturing cost of the apparatus can be reduced.

According to the first aspect of the invention, just before the toner held on the toner holder passes through the gates of the control electrode, the sticking force between the toner and the toner holder or among particles thereof is weakened or the toner is transformed into cloud-like particles, with the result that the toner can easily pass through the gates of the control electrode and the scattering efficiency of the toner is increased to improve the printing quality.

According to the second aspect of the invention, just before the toner held on the toner holder passes through the gates of the control electrode, the toner is controlled by a pulse electric potential consisting of at least one pulse, with the result that such complicated means as oscillation means is not required and the sticking force between the toner and the toner holder or among particles thereof can be weakened or the toner is transformed into cloud-like particles with a simple configuration.

According to the third aspect of the invention, just before the toner held on the toner holder passes through the gates of the control electrode, a pulse electric potential consisting of at least one pulse is applied to the shielded electrode to weaken the sticking force between the toner and the toner holder or among particles thereof, or to transform the toner into cloud-like particles, with a simple-structured control circuit.

According to the fourth aspect of the invention, just before an electric potential is applied to the electrodes disposed at the gates so as to cause the toner held on the toner holder to pass through the gates of the control electrode, a pulse electric potential consisting of at least one pulse is applied to the electrodes to lower the voltage so as to cause the toner to scatter toward the counter electrode.

According to the fifth aspect of the invention, just before the toner held on the toner holder passes through the gates of the control electrode, a pulse electric potential consisting of at least one pulse is applied to the groups of electrodes disposed to the control electrode, whereby a timing to apply the pulse electric potential and the electric potential applied to the gates to cause the toner to scatter toward the counter electrode can be easily adjusted and controlled in a simple manner.

According to the sixth aspect of the invention, the pulse electric potential and the electric potential applied to the gates for causing the toner to scatter toward the counter electrode are applied from the same control circuit, whereby a plurality of control circuits are not required to configure a control circuit in a compact form as well as reduce the manufacturing cost of the apparatus.

Only to the toner held in and in the vicinity of an area facing or capable of facing the gates through which the toner is to pass, a pulse electric potential consisting of at least one pulse is applied, with the result that the sticking force between the toner and the toner holder or among particles thereof is weakened, or the toner is transformed into cloud-like particles, to increase the scattering efficiency of the toner and improve the printing quality.

According to the seventh aspect of the invention, when the pulse width is increased enough, the pulse amplitude is controlled so that an electrical field for enabling the toner to move to the control electrode is formed. Thus, the sticking force between the toner and the toner holder or among particles thereof can be weakened or the toner can be transformed into cloud-like particles to an extent for keeping the toner from passing through the gates of the control electrode.

According to the eighth aspect of invention, the pulse width is controlled so as to be shorter enough than a width of time in which the developer can be moved to the control electrode due to an electrical field formed by the pulse electric potential. Thus, the sticking force between the toner and the toner holder or among particles thereof can be weakened or the toner can be transformed into cloud-like particles to an extent for keeping the toner from passing through the gates of the control electrode.

According to the ninth aspect of the invention, an impulse or a pseudo impulse is supplied to the electrodes as the pulse, whereby the sticking force between the toner and the toner holder or among particles thereof can be weakened or the toner can be transformed into cloud-like particles to an extent for keeping the toner from passing through the gates of the control electrode.

According to the tenth aspect of the invention, the strength of the electrical field, given to the toner due to an electric potential applied to the groups of electrodes of the control electrode by the control circuit so that the toner held on the toner holder in and in the vicinity of the area facing at least the gates through which the toner is to pass is caused to pass through the gates, is smaller than that necessary for the toner to pass through the gates, when the status of the toner is not changed. Thus, the sticking force between the toner and the toner holder or among particles thereof can be weakened or the toner can be transformed into cloud-like particles to an extent for keeping the toner from passing through the gates of the control electrode.

According to the eleventh aspect of the invention, the electric potential applied to the gates for causing the toner to scatter toward the counter electrode can be minimized to prevent a toner leak which is brought about owing to the configuration of the control electrode and then improve the printing quality.

According to the twelfth aspect of the invention, at least the groups of electrodes to which an electric potential is sequentially applied in a specified order is not controlled, whereby the configuration of the control circuit can be simplified and thus the manufacturing cost can be reduced.

According to the thirteenth or fourteenth aspect of the invention, the shielded electrode is divided into a plurality of parts in accordance with at least the distance from the holder or the developer held on the surface of the holder, and the control circuit applies a pulse or impulse having a peak value which differs in accordance with the distance or a pulse or impulse having a pulse width which differs in accordance with the distance. Thus, a degree of the status change of the developer is controlled so that an image can be formed in a uniform or a desired status onto the recording medium surface and the curvature of the holder is not affected to assure high quality printing.

According to the fifteenth aspect of the invention, when the distance between an electrode to which the pulse or impulse is applied and the holder or the developer held on the holder may be different with respect to an arbitrary electrode, the pulse or impulse having a peak value which differs in accordance with the distance. Thus, a degree of the status change of the developer is controlled so that an image is formed in a uniform or a desired status onto the surface of the recording medium and the curvature of the developer holder is not affected to assure high quality printing.

According to the sixteenth aspect of the invention, when the distance between an electrode to which the pulse or impulse is applied and the holder or the developer held on the holder may be different with respect to an arbitrary electrode, the pulse or impulse having a pulse width which differs in accordance with the distance. Thus, a degree of the status change of the developer is controlled so that an image is formed in a uniform or a desired status onto the surface of the recording medium and the curvature of the developer holder is not affected to assure high quality printing.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
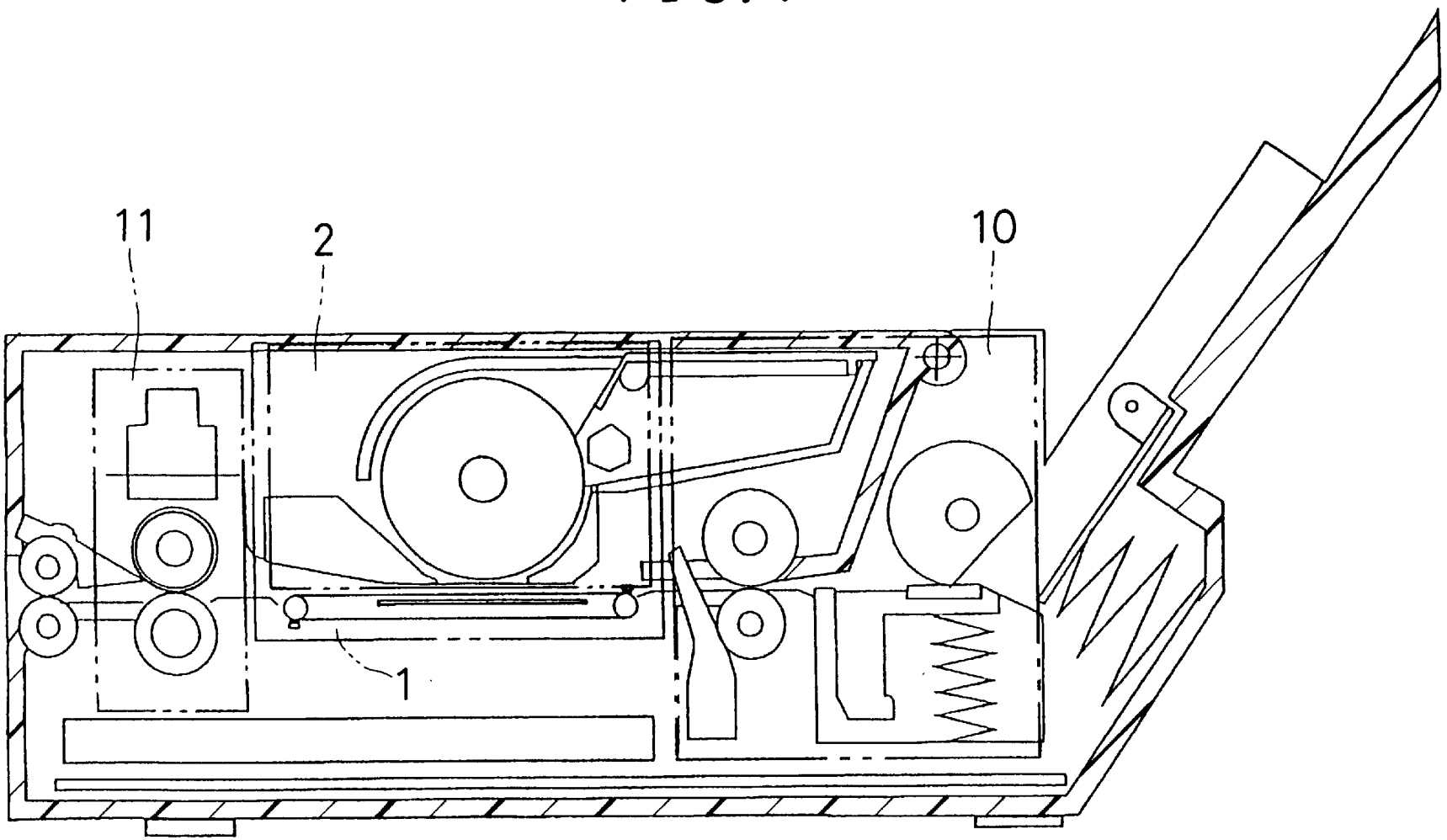
FIG. 1 is a schematic cross sectional view of an image forming apparatus in an embodiment of the present invention.

Now referring to the drawings, preferred embodiments of the invention are described below.

Hereunder, an image forming apparatus which is configured so as to correspond to negatively charged toner will be described in detail. When positively charged toner is to be used, the polarity of each voltage applied may be set properly in accordance with the positively charged toner.

FIG. 1 shows a cross sectional view of a printer in which the image forming apparatus in this embodiment is installed. Each component will be explained briefly referring to FIG. 2.

Figure 2:
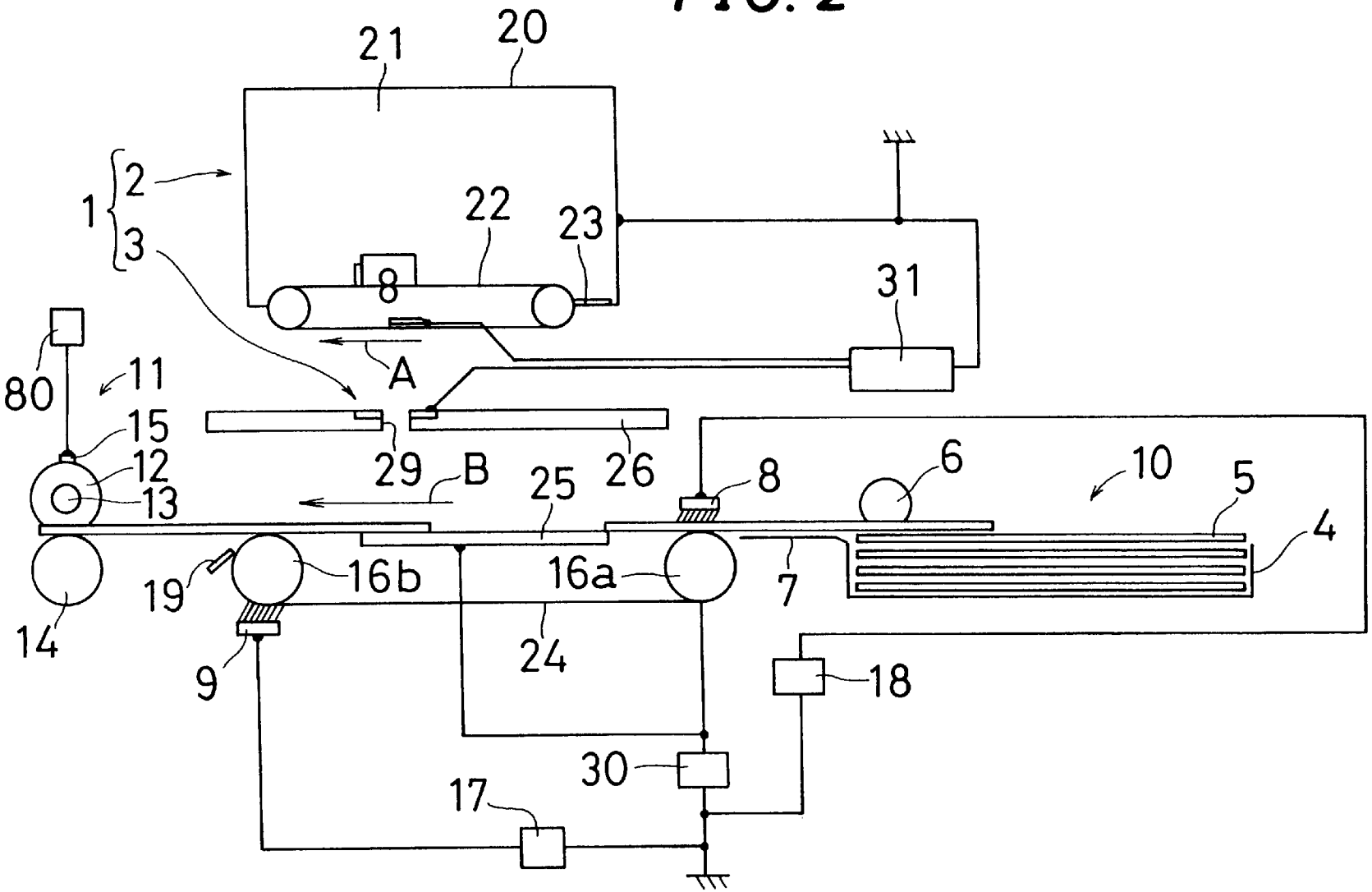
FIG. 2 is a configuration of a major portion of the image forming apparatus in the embodiment of the invention.

As shown in FIG. 2, the printer comprises an image forming unit 1 provided with a toner supplier 2 and a printing device 3. In this image forming unit 1, an image corresponding to an image signal is formed onto paper serving as a recording medium by use of toner serving as a developer. In other words, in the image forming apparatus, toner is scattered to stick to paper as well as the scattering of the toner is controlled based on an image signal to directly form an image onto the paper. At the inlet side where paper is fed to the image forming unit 1, a paper feeding device 10 is provided.

The paper feeding device 10 comprises a paper cassette 4 for holding paper 5 serving as a recording medium; a pick-up roller 6 for feeding the paper 5 from the paper cassette 4; a paper guide 7 for guiding the fed paper 5; and a pair of registration rollers (not illustrated). Further, the paper feeding device 10 also has a paper feed sensor (not illustrated) for detecting that the paper 5 is fed. The pick-up roller 6 is driven by a driving device (not illustrated).

Furthermore, at the outlet side of the paper 5 fed from the image forming unit 1, a fixing unit 11 is provided for heating and pressing toner images formed onto the paper 5 at the image forming unit 1 to fix the toner images onto the paper 5. The fixing unit 11 comprises a heating roller 12, a heater 13, a pressure roller 14, a temperature sensor 15 and a temperature control circuit 80. The heating roller 12 is formed, for example, by an aluminum tube having a thickness of 2 mm. The heater 13 is formed by a halogen lamp or the like and incorporated in the heating roller 12. The pressure roller 14 is made of a material such as silicon resin. The heating roller 12 and the pressure roller 14 that are disposed so as to face each other are under a load (e. g., 2 kg) at both ends of the respective shafts thereof by springs etc. (not illustrated) so that the paper 5 is interposed between the rollers 12 and 14 and pressed by both rollers.

The temperature sensor 15 measures the temperature of the surface of the heating roller 12. The temperature control circuit 80 is controlled by a main control unit to be explained later. The control circuit 80 controls such an operation that the heater 13 turns on/off on the basis of the measurement result of the temperature sensor 15, so that the temperature of the surface of the heating roller 12 is kept for example, at 150° C. The fixing unit 11 has a paper ejection sensor (not illustrated) for detecting that the paper 5 is ejected. The materials of the heating roller 12, the heater 13, the pressure roller 14, etc. are not specified specially. The temperature of the surface of the heating roller 12 is not specified specially, either.

Furthermore, the fixing unit 11 may be configured in a manner that the paper 5 is heated or pressed to fix a toner image thereon. At the paper outlet side of the fixing unit 11, a paper ejection roller (not illustrated) for ejecting the paper 5 processed at the fixing unit 11 onto an ejected paper tray and the ejected paper tray (not illustrated) for receiving the ejected paper 5 are provided.

The heating roller 12, the pressure roller 14 and the paper ejection roller are driven by a driving unit (not illustrated). The toner supplier 2 of the image forming unit 1 comprises: a toner tank 20 for storing toner 21 serving as a developer; a cylindrical toner holder (sleeve) 22 for holding the toner 21 with a magnetic force; and a doctor blade 23 which is provided in the toner tank 20 and used for charging the toner 21 and limiting the thickness of the toner layer held on the outer peripheral surface of the toner holder 22.

The doctor blade 23 is provided at the upstream side in a rotating direction of the toner holder 22 so as to be at a distance (e.g. , 60 $\mu$m) from the outer peripheral surface of the toner holder 22. The toner 21 is magnetic toner and each toner particle thereof has an average diameter of 6 $\mu$m. The toner particles are charged by the doctor blade 23 so that the charging level is, for example, within a range of −4 $\mu$C/g to −5 $\mu$C/g. The distance between the doctor blade 23 and the toner holder 22 is not specified specially. The average diameter of the toner particles and the charging level of the toner 21 are not specified specially, either.

The toner holder 22 is driven by a driving device (not illustrated) and rotated at a surface rotation speed of, for example, 80 mm/sec in a direction of arrow A in FIG. 2. The toner holder 22 is grounded, a magnet (not illustrated) is disposed and at a position facing the doctor blade 23 in the toner holder 22 and also facing a control electrode 26 to be explained later. Accordingly, the toner holder 22 can hold the toner 21 on the outer peripheral surface thereof.

The toner 21 held on the outer peripheral surface of the toner holder 22 is formed into a bristle at a position of the peripheral surface corresponding to the above-mentioned position. The rotation speed of the toner holder 22 is not specified specially. The toner holder 22 may be configured so as to hold the toner 21 with an electric force or a combination of an electric force and a magnetic force, instead of a magnetic force.

The printing device 3 of the image forming unit 1 is formed by an aluminum plate of 1 mm in thickness, for example. The printing device 3 includes: a counter electrode 25 facing the outer peripheral surface of the toner holder 22; a high voltage power supply 30 for supplying a high voltage to the counter electrode 25; a control electrode 26 provided between the toner holder 22 and the counter electrode 25; a discharging power supply 17 for supplying a discharging electric potential to the discharging brush 9; a charging brush 8 for charging the paper 5; a charging power supply 18 for supplying a charging electric potential to the charging brush 8; a dielectric belt 24; supporting members 16*a* and 16*b* for supporting the dielectric belt 24; and a cleaner blade 19. The counter electrode 25 is provided so as to be at a distance of 1.1 mm from the outer peripheral surface of the toner holder 22.

The dielectric belt 24 is basically made of PVDF (polyvinylidene fluoride) and has a volume resistivity of 1010 Ω·cm and a thickness of 75 μm. The dielectric belt 24 is driven by a driving device (not illustrated) and rotated at the surface rotation speed of 30 mm/sec, for example, in a direction of arrow B. A high voltage (e.g., 2.3kV) is applied to the counter electrode 25 from the high voltage power supply (controlling means) 30. In other words, an electrical field necessary for scattering the toner 21 held on the toner holder 22 is provided between the counter electrode 25 and the toner holder 22 due to a high voltage applied from the high voltage power supply 30.

The discharging brush 9 is provided so as to press against the dielectric belt 24 at the downstream side of the control electrode 26 in a rotating direction of the dielectric belt 24. A discharging electric potential of 2.5kV is applied to the discharging brush 9 from the discharging power supply 17, so that unnecessary charge is removed from the surface of the dielectric belt 24.

When the toner 21 sticks to the surface of the dielectric belt 24 due to an unexpected event such as a paper jam, the cleaning blade 19 removes the toner 21 to prevent the back side of the paper from being soiled by the toner 21. The material of the electrode 21 is not specified specially. The distance between the counter electrode 25 and the toner holder 22 is not specified specially, either. Further, the rotation speed of the counter electrode 25 and the voltage applied to the counter electrode 25 are not specified specially, either.

The image forming apparatus further comprises: a main control unit, serving as a control circuit, for controlling the whole image forming apparatus; an image processing unit for converting image data obtained from an image reader for reading image of originals etc. into a format in which the image data is to be printed; an image memory for storing the converted image data; and an image forming control unit for converting the image data obtained from the image processing unit into image data to be given to the control electrode 26, which are not illustrated.

The control electrode 26 is disposed in parallel to a tangential direction of the surface of the counter electrode 25 and extended two-dimensionally facing the counter electrode 25, so that a toner flow can pass from the toner holder 22 toward the counter electrode 25. Due to an electric potential supplied to the control electrode 26, the electric field existing between the toner holder 22 and the counter electrode 25 is changed, so that the scattering of the toner 21 from the toner holder 22 to the counter electrode 25 is controlled.

Figure 3:
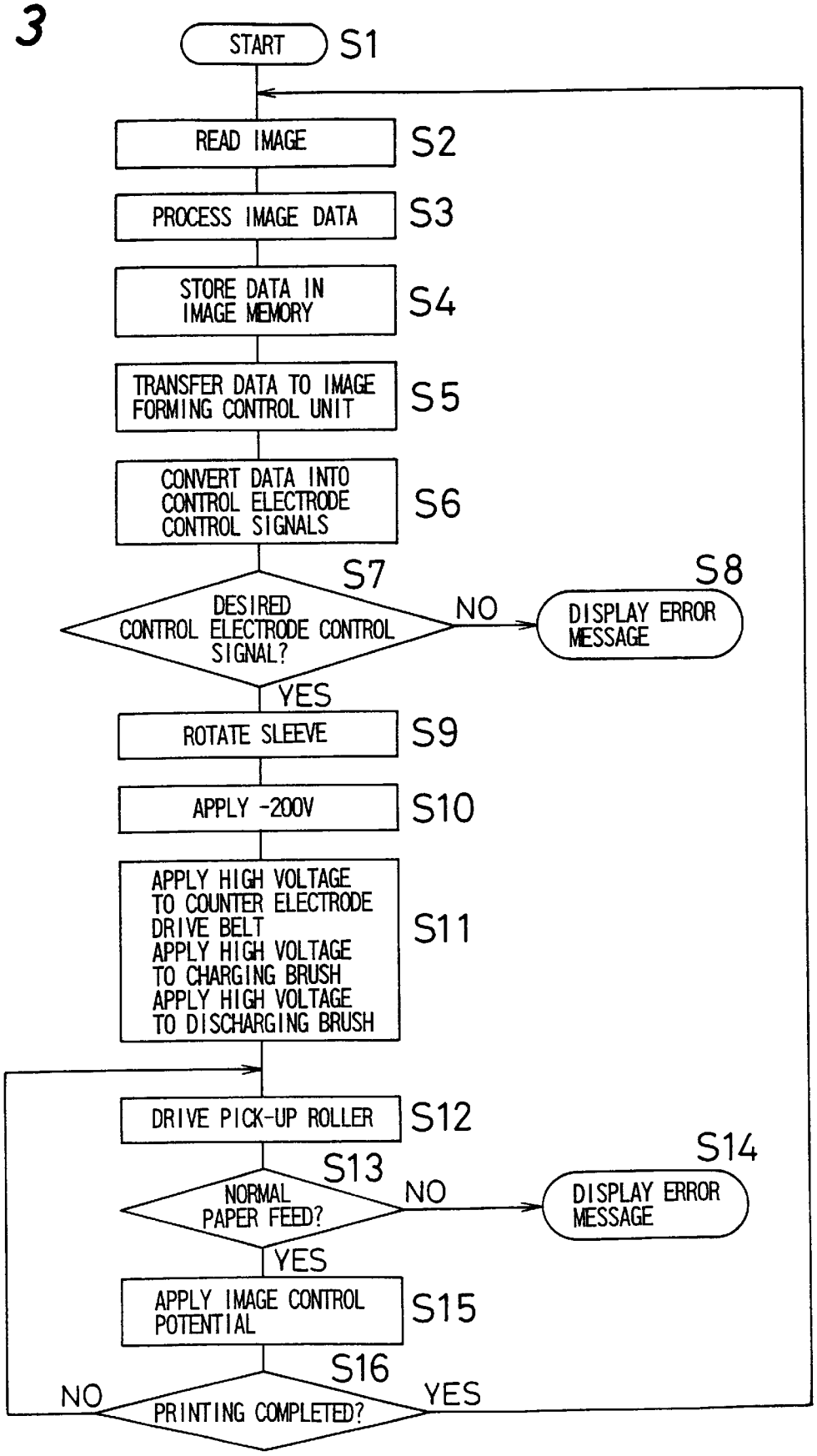
FIG. 3 is a flow chart for explaining an image forming operation in the embodiment of the invention.

Although the image forming apparatus is used as a printing device of a printer as described above, the apparatus may be also used as a printing device of a facsimile machine, a digital coping machine, etc. An image forming operation in the image forming apparatus when the apparatus is used as, for example, a printing device of a digital coping machine will be explained referring to FIG. 3.

Firstly in step S1, for instance, when an original to be copied is put on an image reader and a COPY-START button (not illustrated) is pressed, the main control unit receives an input that the COPY-START button is pressed and then starts an image forming operation. In other words, the original image is read by the image reader in step S2, the obtained image data is processed by the image processing unit in step S3, and the processed image data is stored in the image memory in step S4.

Furthermore, the image data stored in the image memory is transferred to the image forming control unit in step S5, and the input image data is converted into control electrode control signals to be given to the control electrode 26 in the image forming control unit in step S6. When the image forming control unit receives a predetermined volume of control electrode control signals in step S7, the operation proceeds to step S9. When the unit fails to receive the predetermined volume of control electrode control signals, the operation proceeds to step S8, where an error message is displayed. In and after step S9, a driving unit (not illustrated) is actuated, the pick-up roller 6 shown in FIG. 2 is driven to rotate by the driving unit to feed the paper 5 from the paper cassette 4 toward the image forming unit 1, as well as a normal status of paper feeding is detected by the paper feed sensor.

More concretely, the toner holder 22 is rotated in step S9. In step S10, an arbitrary voltage (e. g., −200V) is applied to the control electrode 26. Then, in step S11, a comparatively high voltage is applied to the counter electrode 25 to drive the dielectric belt 24, and a comparatively high voltage is applied to the charging brush 8 and the discharging brush 9, respectively. After this, in step S12, the pick-up roller 6 is driven. Then, in step S13, it is judged whether or not the paper is fed normally based on the detection result of the paper feed sensor. When it is judged to be normal, the operation proceeds to step S15. When judged not to be normal, the operation proceeds to step 14, where an error message is displayed. An image control electric potential is applied to the control electrode 26 in step S15, and then the operation proceeds to step S16. The operations of step S12 to S16 are repeated until printing is completed. When printing is completed, the operation returns to step S2.

The paper 5 fed by the pick-up roller 6 is conveyed to between the charging brush 8 and the supporting member 16*a*. The same electric potential as that of the counter electrode 25 is applied to the supporting member 16*a* from the high voltage power supply 30. A voltage of 1.2kV is applied to the charging brush 8 from the charging power supply 18 as a charging electric potential. The paper 5 is charged according to the electric potential difference between the charging brush 8 and the supporting member 16*a*, and, with electrostatically absorbed, conveyed to the side of a surface of the dielectric belt 24 which faces the toner holder 22 in the printing device 3 of the image forming unit 1. The predetermined volume of control electrode control signals depends on the configuration etc. of the image forming apparatus.

After this, the image forming control unit supplies the control electrode control signals to a control power supply 31. The control electrode control signals are supplied in synchronization with the paper 5 conveyed to the printing device 3 by the charging brush 8. The control power supply 31 controls a high voltage to be applied to the control electrode 26 based on the control electrode control signals.

The control power supply 31 applies a voltage of 150V or −200V to specified electrodes of the control electrode 26 as necessary, so that the electrical field formed around the control electrode 26 is controlled. In other words, at the gates 29 of the control electrode 26, scattering of the toner 21 from the toner holder 22 to the counter electrode 25 is prevented and released as necessary according to image data. Consequently, a toner image according to image signals is formed onto the paper 5 being conveyed toward the paper outlet side at a speed of 30 mm/sec due to the rotation of the counter electrode 25.

The paper 5 onto which the toner image is formed is separated from the dielectric belt 24 due to the curvature of the supporting member 16*b* and conveyed into the fixing unit 11. The toner image is fixed onto the paper 5 in the fixing unit 11. The paper 5 onto which the toner image is fixed is ejected by the paper ejection roller onto the paper tray and the normal ejection of the paper is detected by the paper ejection sensor. On the basis of the detection, the main control unit determines that printing is normally completed. With the image forming operation described above, a satisfactory image is formed onto the paper 5.

Since the image forming apparatus forms an image directly onto the paper 5, such an image forming member as a sensitive member and a dielectric drum used in a conventional image forming apparatus is not needed. Therefore, an operation of transferring an image from an image forming member onto the paper 5 is omitted, so that an image can be prevented from being degraded. Thus, the reliability of the apparatus can be improved. Further, the configuration of the apparatus can be simplified and the number of parts can be reduced, with the result that a compact and low-price image forming apparatus can be manufactured.

[First Embodiment]

Figure 4:
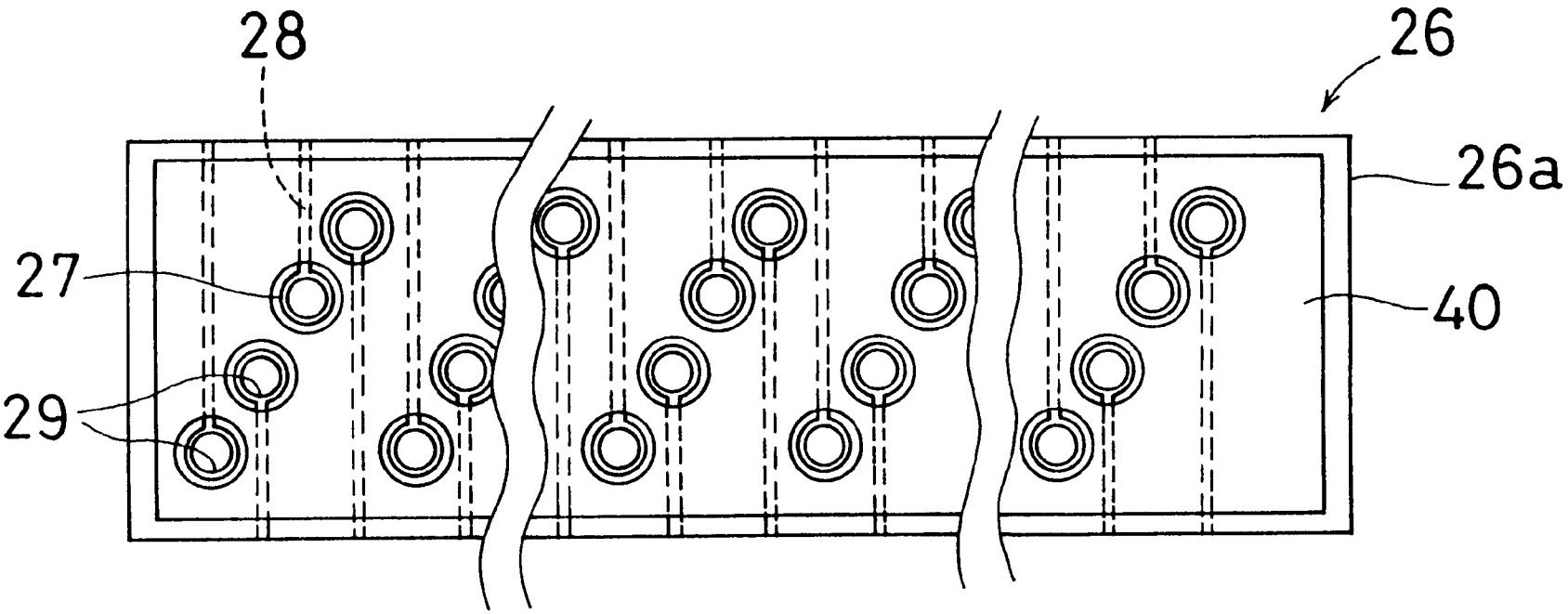
FIG. 4 is a top view of a configuration of a control electrode in the embodiment of the invention.

In the image forming apparatus described above, the control electrode 26 is disposed so as to be at a distance (e.g., 100 μm) from the outer peripheral surface of the toner holder 22 and fixed by a supporting member (not illustrated). As shown in FIG. 4, the control electrode 26 comprises: an insulated substrate 26*a*; a high voltage driver (not illustrated); ring-like electric conductors which are independent of each other, i.e., ring-like electrodes 27; and a plate-like shielded electrode 40 provided with openings corresponding to the respective ring-like electrodes 27. The insulated substrate 26*a* is made of a material such as polyimide resin to have a thickness of 25 μm.

On the insulated substrate 26*a* are formed holes serving as gates 29 to be explained later. The ring-like electrodes 27 are made of a material such as copper foil to be disposed around the holes and to be positioned in accordance with a specified arrangement. The openings of the respective holes, having an diameter of 160 μm, for example, allow the toner 21 scattered from the toner holder 22 to the counter electrode 25 to pass therethrough. Hereunder, the holes will be referred to as the gates 29.

The shielded electrode 40 is provided with openings corresponding to the ring-like electrodes 27 which are made of a material such as copper foil and disposed at or around the gates 29. The distance between the control electrode 26 and the toner holder 22 is not specified specially. Each of the ring-like electrodes 27 is provided with an opening having a diameter of 220 μm. The size of the gates 29 and the material, thickness, etc. of the insulated substrate 26*a*, the ring-like electrodes 27 and the shielded electrode 40 are not specifically restricted.

For example, 2560 gates 29, namely, 2560 holes are formed in the respective ring-like electrodes 27. The respective ring-like electrodes 27 are electrically connected to the control power supply 31 via power lines 28 and a high voltage driver (not illustrated). The shielded electrode 40 is electrically connected to the control power supply 31 via the power lines. The number of the ring-like electrodes is not specified specially.

The surfaces of the ring-like electrodes 27, the shielded electrode 40 and the power lines 28 are covered by an insulator layer (not illustrated) with a thickness of 30 μm. Accordingly, an insulating performance is ensured among the ring-like electrodes 27, among the power lines 28, and between the ring-like electrode 27 and the power line 28 that are not connected to each other. Further, the surfaces of the ring-like electrodes 27, the shielded electrode 40 and the power lines 28 are protected from short-circuiting with other members or electrically conductive materials. The material and thickness etc. of the insulator layer are not specified specially.

A pulse, i.e., a voltage is applied to the ring-like electrodes 27 of the control electrode 26 from the control power supply 31 in accordance with an image signal. In other words, the control power supply 31 applies a voltage (e.g., 150V) to the ring-like electrodes 27 for causing the toner 21 held on the toner holder 22 to pass through toward the counter electrode 25, and applies a voltage (e.g., −200V) for keeping the toner from passing through.

A single pulse voltage is applied to the shielded electrode 40 from the control power supply 31. The pulse must be applied just before a voltage is applied to the ring-like electrodes 27 so as to scatter the toner 21 toward the counter electrode 25. Hereunder, the movement of the toner 21 held on the toner holder when a pulse electric potential is applied to the shielded electrode will be described referring to FIGS. 5 and 6.

Figure 5:
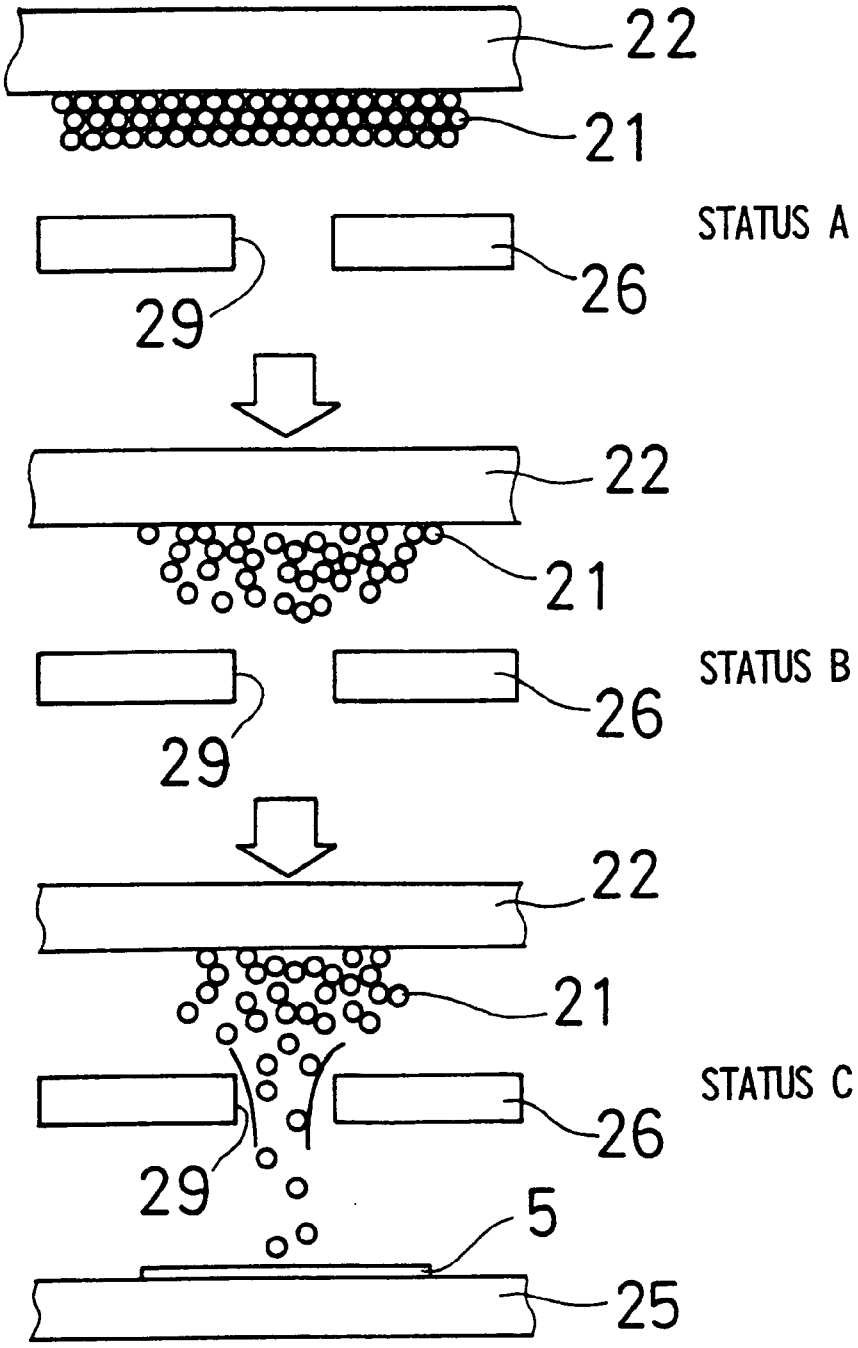
FIG. 5 illustrates a movement of the developer in the image forming unit in the embodiment of the invention.

In the state A shown in FIG. 5, the toner 21 is held on the toner holder 22 in a form of a toner layer with a predetermined thickness. At this time, a voltage to keep the toner 21 from passing through the gates 29 of the control electrode 26 is applied to the respective ring-like electrodes 27 of the control electrode 26. Also, a voltage to keep the toner 21 from passing through the gates 29 of the control electrode 26 is applied to the shielded electrode 40.

Figure 6:
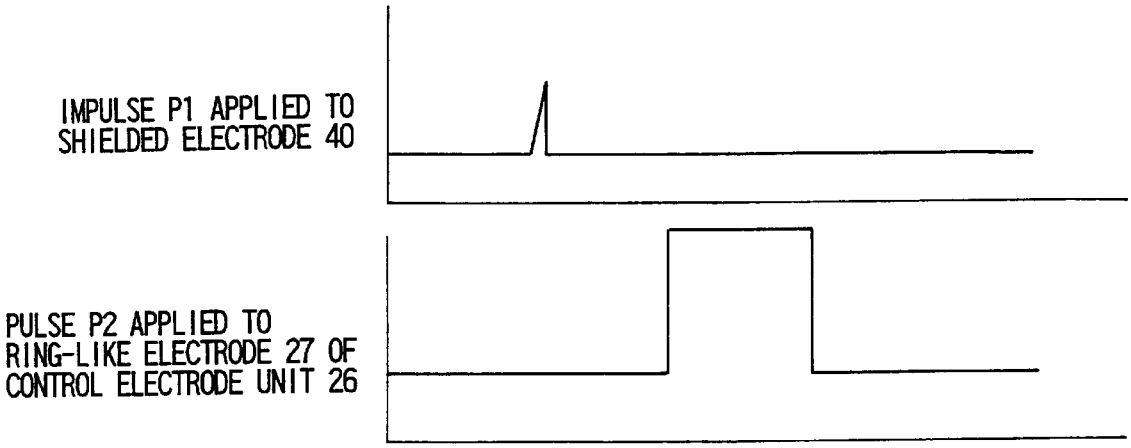
FIG. 6 illustrates an electric potential control of the control electrode in the embodiment of the invention.

In the state B shown in FIG. 5, a single pulse voltage is applied to the shielded electrode 40 from the control power supply 31. At this time, an impulse P1 with the maximum voltage value (e.g., 100V) as shown in FIG. 6 is applied to the shielded electrode 40. In the toner 21 held on the toner holder 22 in a form of a toner layer with a predetermined thickness, a sticking force between the toner and the toner holder 22 or among particles thereof is weakened, whereby the toner 21 is held between the toner holder 22 and the control electrode 26 in a state that the binding force thereof is slightly left. This state is often referred to as a toner cloud state, but nothing is different specially in a state change.

At this moment, in order to prevent the toner 21 with a weakened sticking force from passing through the gates 29 of the control electrode 26 or from sticking to the control electrode 26, a voltage of the impulse P1 must be applied to the shielded electrode 40. Furthermore, a voltage for keeping the toner 21 from passing through the gates 29 of the control electrode 26 must be applied must be applied to the ring-like electrodes 27 of the control electrode 26. The purpose is to avoid that the toner 21 held on the toner holder 22 in a form of a toner layer with a predetermined thickness loses a sticking force between the toner and the toner holder 22 or among particles thereof due to an electric potential of the impulse P1 applied to the shielded electrode 40 and then the toner 21 held between the toner holder 22 and the control electrode 26 in a state that the binding force is slightly left passes through the gates 29 of the control electrode 26.

In the state C shown in FIG. 5, a voltage is applied to the ring-like electrodes 27 of the control electrode 26 from the control power supply 31 so that the toner 21 passes through the gates 29 of the control electrode 26 to be scattered toward the counter electrode 25. At this time, a pulse P2 with the maximum voltage (e.g., 150V) as shown in FIG. 6 is applied to the ring-like electrodes 27. In the state B shown in FIG. 5, the sticking force between the toner 21 and the toner holder 22 or among particles of the toner 21 is weakened, with the result that the toner 21 held between the toner holder 22 and the control electrode 26 in a state that the binding force is slightly left passes through the gates 29 of the control electrode 26 to be scattered on the paper 5 being conveyed on the counter electrode 25.

In the state B shown in FIG. 5, the toner 21 with a weakened sticking force between the toner 21 and the toner holder 22 or among the toner particles is held between the toner holder 22 and the control electrode 26 in a state that the binding force is slightly left. Accordingly, it is possible to minimize the voltage applied so that the toner 21 passes through the gates 29 of the control electrode 26 to be scattered toward the counter electrode 25, as long as the toner 21 can pass through the gates 29 of the control electrode 26.

As described above, a pulse is applied to the shielded electrode just before the toner held on the toner holder passes through the gates of the control electrode, so that the sticking force between the toner and the toner holder or among the toner particles is weakened, or the toner is transformed into cloud-like particles. Accordingly, it is possible to make the toner easily pass through the gates of the control electrode and increase the scattering efficiency of the toner to improve the printing quality.

[Second Embodiment]

In the image forming apparatus described above, the control electrode 26 is positioned so as to be at a distance (e.g., 100 μm) from the outer peripheral surface of the toner holder 22 and fixed by supporting members (not illustrated).

Figure 7:
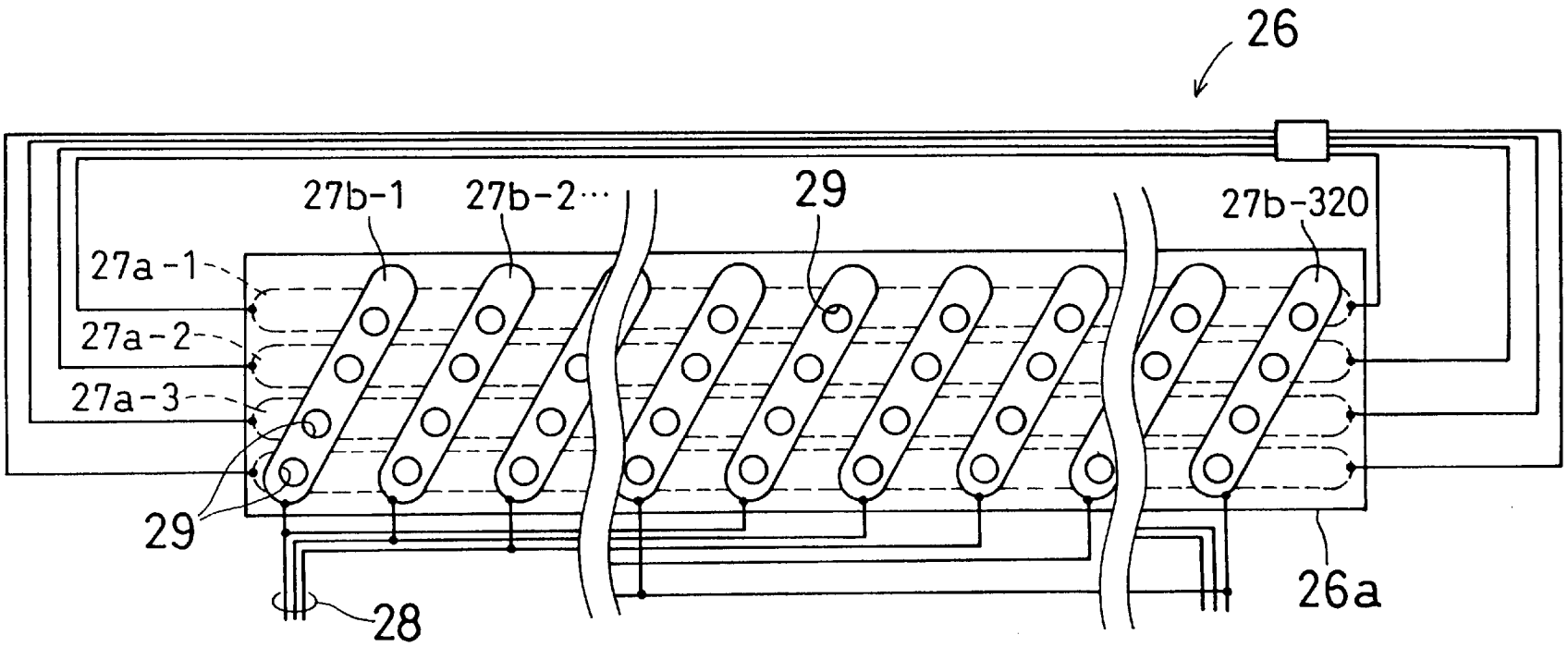
FIG. 7 is a top view of a configuration of the control electrode in an embodiment of the invention.

As shown in FIG. 7, the control electrode 26 includes a plurality of belt-like electrodes 27*a*-1 . . . and 27*b*-1 . . . on both sides of the insulated substrate 26*a* in a so-called matrix form, and a voltage applied to the belt-like electrodes 27*a*-1 . . . and 27*b*-1 . . . that are orthogonal to each other is controlled, so that a scattering of the toner 21 from the toner holder 22 to the counter electrode 25 is controlled.

The insulated substrate 26*a* is made of a material such as polyimide resin and formed to have a thickness of 25 μm. The insulated substrate 26*a* is provided with holes serving as gates 29. The belt-like electrodes 27*a*-1 . . . and 27*b*-1 . . . are made of a material such as copper foil and disposed in accordance with a specified alignment. A diameter of each of the gates 29 is arbitrarily selected (e.g., 160 μm) and the toner 21 scattering from the toner holder 22 to the counter electrode 25 passes through the gates. The distance between the control electrode 26 and the toner holder 22 is not specified specially. Each of the belt-like electrodes 27*a*-1 . . . and 27*b*-1 . . . is provided with an opening whose diameter is 220 μm at the points where the belt-like electrodes intersect with each other at right angles. The size of the gates 29, and the materials and thickness etc. of the insulated substrate 26*a* and the belt-like electrodes 27*a*-1 . . . and 27*b*-1 . . . are not specified specially.

The number of the gates 29 is arbitrarily selected (e.g., 2560). The respective belt-like electrodes 27*a*-1 . . . and 27*b*-1 . . . are electrically connected to the control power supply 31 via the power lines 28 and high voltage drivers (not illustrated). Since the gates 29 can be controlled by the unit of block by the belt-like electrodes 27*a*-1 . . . and 27*b*-1 . . ., the number of lines of the power lines 28 and the number of high voltage drivers can be reduced.

The surfaces of the belt-like electrodes 27*a*-1 . . . and 27*b*-1 . . . and the power lines 28 are covered by an insulator layer (not illustrated) with a thickness of 30 μm. Consequently, insulation is ensured among the belt-like electrodes 27*a*-1 . . . and 27*b*-1 . . . , among the power lines 28, and between the belt-like electrodes 27*a*-1 . . . and 27*b*-1 . . . and the respective power lines 28 that are not connected to each other. In addition, the surfaces of the belt-like electrodes 27*a*-1 . . . and 27*b*-1 . . . and the power lines 28 are protected from short-circuiting with other members or conductive substances. The material, thickness, and so on of the insulator layer are not specified specially.

A pulse, i.e., a voltage in accordance with an image signal is applied to the belt-like electrodes 27*a*-1 . . . and 27*b*-1 . . . of the control electrode 26 from the control power supply 31. In other words, the control power supply 31 applies an arbitrary voltage (e.g., 150V) to the belt-like electrodes 27*a*-1 . . . and 27*b*-1 . . . for causing the toner 21 held on the toner holder 22 to pass through toward the counter electrode 25, and applies any voltage (e.g., −200V) to the electrodes for keeping the toner 21 from passing through.

A pulse, which is applied so as to weaken the sticking force between the toner 21 and the toner holder 22 or between the toner particles to each other or transform the toner 21 into cloud-like particles just before the toner 21 held on the toner holder 22 passes through the gates of the control electrode, is applied to groups of electrodes to which no electric potential is sequentially applied in a specified order, i.e., the belt-like electrodes 27*b*-1 . . . .

The reason for the above is as follows. Since groups of electrodes to which an electric potential is sequentially applied in a specified order, i.e., the belt-like electrodes 27*a*-1 . . . are positioned in parallel to the toner holder 22, when, for example, a voltage for causing the toner 21 held on the toner holder 22 to pass through toward the counter electrode 25 is applied to the belt-like electrodes 27*a*-1 . . . , the toner 21 with a weakened sticking force between the toner 21 and the toner holder 22 or between the toner particles may pass through even gates where the toner is not to pass through. Such toner will appear as a so-called toner leak on an image, with the result that the printing quality is degraded. Accordingly, when a pulse is applied in the longitudinal direction of the toner holder 22, a problem such as a toner leak is brought about, which is not preferable.

In the first embodiment, the method for applying a pulse to the shielded electrode is described, wherein the control electrode 26 comprises ring-like electrodes and hence a toner leak as described above never occurs. A toner leak is a problem that when the control electrode 26 in which electrodes are arranged in a matrix form is controlled, a voltage for causing the toner 21 to pass through is applied to one part of the electrodes at the gates where the toner 21 is not to pass through.

A pulse is applied to groups of electrodes to which an electric potential is not sequentially applied in a specified order, i.e., the belt-like electrodes 27*b*-1 . . . . Since the groups of electrodes are disposed perpendicularly to the toner holder 22, a toner leak as described above will not occur.

The movement of the toner held on the toner holder when a pulse electric potential is applied to the belt-like electrodes 27*b*-1 . . . is already explained referring to FIG. 5 in the first embodiment, so no more explanation will be made for the same.

Figure 8:
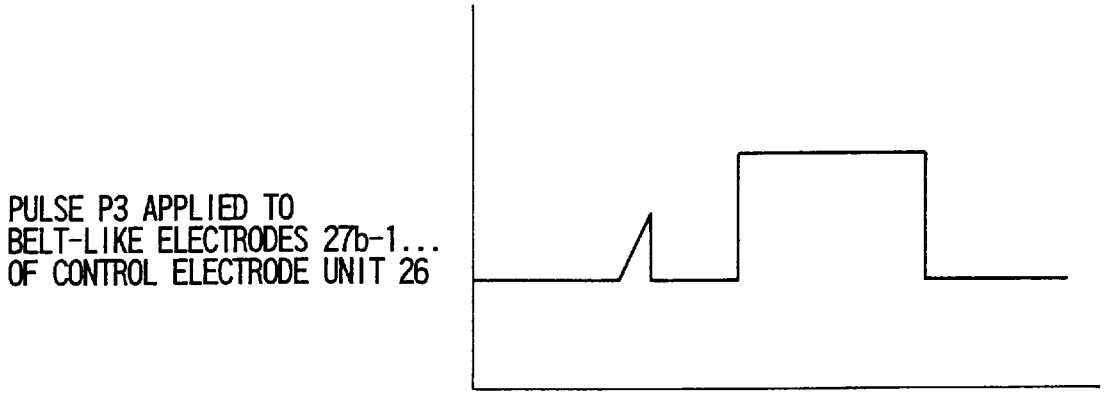
FIG. 8 illustrates an electric potential control of the control electrode in the embodiment of the invention.

The respective timings for applying a pulse electric potential to the belt-like electrodes 27*b*-1 . . . and applying an electric potential for scattering the toner 21 will be a pulse P3 as shown in FIG. 8. In FIG. 8, to the belt-like electrodes 27*b*-1 . . . to which an electric potential in a direction that the toner 21 is not scattered is applied, a pulse whose width is smaller than an electric potential in a direction that the toner 21 is scattered, i.e., an impulse or a pseudo impulse is applied with an amplitude that an electrical field enabling the toner 21 to move toward the control electrode 26.

The reason for the above is as follows. Unless an electrical field in which the toner 21 begins to scatter is formed in the pulse amplitude, the sticking force between the toner 21 and the toner holder 22 or between the toner particles to each other cannot be weakened. In addition, unless the pulse amplitude is narrower than the electric potential for scattering the toner 21, the toner 21 cannot be held between the toner holder 22 and the control electrode 26 without causing the toner 21 to pass through the gates 29 of the control electrode 26. Also the strength of the electrical field given to the toner 21 must be lower than that of the electrical field formed for passing the toner 21 through the gates 29.

When a pulse is applied to the groups of electrodes of the control electrode 26 to which no electric potential is sequentially applied in a specified order, i.e., the belt-like electrodes 27*b*-1 . . . , it is possible to weaken the sticking force between the toner and the toner holder or between the toner particles to each other or transform the toner into cloud-like particles without causing any toner leak. Thus, the scattering efficiency of the toner can be increased without degrading the printing quality to improve the printing quality.

[Third Embodiment]

In the image forming apparatus described above, when the toner holder 22 is formed to be cylindrical a sleeve, the curvature of the toner holder 22 is critical.

An electrical field strength acting at an area between the center portions of the toner holder 22 and the control electrode 26 differs from that acting at an area between both ends thereof. With regard to a scatter of the toner 21, for example, when the same level of voltage is applied to each group of electrodes of the control electrode 26, the toner 21 is scattered differently in volume between the center area and the area of both ends of the control electrode 26. For instance, even when a desired amount of toner 21 is scattered in the center area of the control electrode 26, the amount of the scattered toner 21 in the area of both ends of the control electrode 26 is less than that in the center portion.

This is because a distance from the toner holder 22 to the center area of the control electrode 26 is shorter than that from the toner holder 22 to the area of both ends of the control electrode 26. Thus, the electrical field acting between the toner holder 22 and the area of both ends of the control electrode 26 is weaker.

Such a phenomenon also affects generation of the toner cloud mentioned in the present invention. For instance, when a micro pulse or impulse is applied to the shielded electrode 40, the sticking force between the toner and the toner holder or the toner particles to each other is less weakened in the toner 21 held on the toner holder 22 corresponding to both ends of the control electrode 26 compared to in the toner 21 held on the toner holder 22 corresponding to the center portion of the control electrode 26.

The shielded electrode 40 is divided into parts according to the distance between the toner holder 22 and the control electrode 26, so that the peak value of the micro pulse or impulse applied to the shielded electrode 40 is varied in accordance with the distance between the toner holder 22 and the control electrode 26. Accordingly, it is possible to correct the difference in a degree that the sticking force between the toner 21 and the toner holder 22 or between the toner particles to each other is weakened, between the center area and the area of both ends of the control electrode 26 due to the curvature of the toner holder 22. Furthermore, it is also possible to obtain the same effect as the above by varying the width of the pulse or impulse applied to the shielded electrode 40.

[Fourth Embodiment]

In the image forming apparatus described above, when the toner holder 22 is formed to be cylindrical a sleeve, the curvature of the toner holder 22 is critical.

An electrical field strength acting at an area between the center portions of the toner holder 22 and the control electrode 26 differs from that acting at an area between both ends thereof. With regard to a scatter of the toner 21, for example, when the same level of voltage is applied to each group of electrodes of the control electrode 26, the toner 21 is scattered differently in volume between the center area and the area of both ends of the control electrode 26. For instance, even when a desired amount of toner 21 is scattered in the center area of the control electrode 26, the amount of the scattered toner 21 in the area of both ends of the control electrode 26 is less than that in the center portion.

This is because a distance from the toner holder 22 to the center area of the control electrode 26 is shorter than that from the toner holder 22 to the area of both ends of the control electrode 26. Thus, the electrical field acting between the toner holder 22 and the area of both ends of the control electrode 26 is weaker.

Such a phenomenon also affects generation of the toner cloud mentioned in the present invention. For instance, when a micro pulse or impulse is applied just before an electric potential for scattering the toner 21 is applied to the control electrode 26, the sticking force between the toner and the toner holder or between the toner particles to each other is less weakened in the toner 21 held on the toner holder 22 corresponding to both ends of the control electrode 26 compared to in the toner 21 held on the toner holder 22 corresponding to the center portion of the control electrode 26.

When a distance between the toner holder 22 and an arbitrary electrode of the control electrode 26 is different from a predetermined distance between the toner holder 22 and the control electrode 26, the peak value of the micro pulse or impulse applied to the arbitrary electrode of the control electrode 26 is varied according to the distance between the toner holder 22 and the electrode. Accordingly, it is possible to correct the difference in a degree that the sticking force between the toner 21 and the toner holder 22 or between the toner particles to each other is weakened, between the center area and the area of both ends of the control electrode 26 due to the curvature of the toner holder 22. Furthermore, it is possible to obtain the same effect as the above by varying the width of the pulse or impulse applied to the shielded electrode 40.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

supplying means having a holder for holding a developer for developing at least one color;

a counter electrode disposed so as to face the holder;

a control electrode disposed between the holder and the counter electrode, including:

an insulated substrate provided with a plurality of gates through which the developer passes, one or more groups of electrodes disposed around the plurality of gates of the insulated substrate, and a shielded electrode having openings corresponding to the plurality of gates of the insulated substrate, the shielded electrode being disposed on the insulated substrate so that a part of the groups of electrodes is exposed directly or electrically to the holder through the openings;

controlling means having a control circuit, for applying at least a predetermined electric potential according to image data, to respective electrodes of the control electrodes;

wherein the image forming apparatus forms an image on a surface of a recording medium fed to between the control electrode and the counter electrode while the passage of the developer through the gates is controlled by applying a predetermined electric potential to the groups of electrodes by the controlling means;

wherein, just before passing through the gates, the developer is controlled so that a change in the status of the developer is obtained such that a sticking force between the developer and the holder or among particles thereof is weakened, or that the developer is transformed into cloud-like particles; and wherein the status of the developer is controlled by a pulse electric potential generated by the control circuit.

2. The image forming apparatus of claim 1, wherein the pulse electric potential comprises at least a single pulse generated by the control circuit.

3. The image forming apparatus of claim 2, wherein the control circuit applies the pulse electric potential to the shielded electrode.

4. The image forming apparatus of claim 1, wherein the control circuit controls an amplitude of the pulse so that an electrical field for enabling the developer to move to the control electrode unit when a width of the pulse is sufficiently increased.

5. The image forming apparatus of claim 1, wherein the control circuit controls a width of the pulse so as to be shorter than a width of time in which the developer can be moved to the control electrode due to an electrical field formed by the pulse electric potential.

6. The image forming apparatus of claim 1, wherein the control circuit supplies an impulse or a pseudo impulse to the electrode as the pulse.

7. The image forming apparatus of claim 1, wherein the strength of the electrical field given to the developer due to the electric potential applied to the groups of electrodes by the control circuit is given to the developer held in and in the vicinity of an area of the holder facing at least the gates to cause the developer to pass through due to the electric potential applied so as to cause the developer to pass through the gates, the strength of the electrical field being smaller than the strength of the electrical field necessary for the developer to pass through the gates when the developer is not changed in status.

8. An image forming apparatus comprising:

supplying means having a holder for holding a developer for developing at least one color;

a counter electrode disposed so as to face the holder;

a control electrode disposed between the holder and the counter electrode, including:

an insulated substrate provided with a plurality of gates through which the developer passes, one or more groups of electrodes disposed around the plurality of gates of the insulated substrate, and a shielded electrode having openings corresponding to the plurality of gates of the insulated substrate, the shielded electrode being disposed on the insulated substrate so that a part of the groups of electrodes is exposed directly or electrically to the holder through the openings;

controlling means having a control circuit, for applying at least a predetermined electric potential according to image data, to respective electrodes of the control electrode;

wherein the image forming apparatus forms an image on a surface of a recording medium fed to between the control electrode and the counter electrode while the passage of the developer through the gates is controlled by applying a predetermined electric potential to the groups of electrodes by the controlling means;

wherein, just before passing through the gates, the developer is controlled so that a change in the status of the developer is obtained such that a sticking force between the developer and the holder or among particles thereof is weakened, or that the developer is transformed into cloud-like particles; and wherein just before applying an electric potential to be applied to the electrodes disposed to the gates so as to cause the developer to pass through the gates, the control circuit applies a pulse electric potential to the electrodes.

9. The image forming apparatus of claim 8, wherein the control circuit applies the pulse electric potential to the groups of electrodes disposed to the control electrode.

10. The image forming apparatus of claim 8, wherein the control circuit applies the pulse electric potential and the electric potential applied so as to cause the developer to pass through the gates, from the same control circuit.

11. An image forming apparatus comprising:

supplying means having a holder for holding a developer for developing at least one color;

a counter electrode disposed so as to face the holder;

a control electrode disposed between the holder and the counter electrode, including:

an insulated substrate provided with a plurality of gates through which the developer passes, and one or more groups of electrodes including a first group of electrodes disposed around the plurality of gates on the holder side surface of the insulated substrate and a second group of electrodes disposed around the plurality of gates on the counter electrode side surface of the insulated substrate;

controlling means having a control circuit for applying at least a predetermined electric potential according to image data to respective electrodes of the control electrode, and wherein the image forming apparatus forms an image on a surface of a recording medium fed to between the control electrode and the counter electrode while the passage of the developer through the gates is controlled by applying a predetermined electric potential to the groups of electrodes by the controlling means;

wherein, just before passing through the gates, the developer is controlled so that a change in the status of the developer is obtained such that a sticking force between the developer and the holder or among particles thereof is weakened, or that the developer is transformed into cloud-like particles; and wherein the status of the developer is controlled by a pulse electric potential generated by the control circuit.

12. The image forming apparatus of claim 11, wherein the control circuit does not control at least the groups of electrodes to which an electric potential is sequentially applied in a specified order.

13. The image forming apparatus of claim 11, wherein when a distance between an electrode to which the pulse or impulse is to be applied and the holder or the developer held on the holder may be different with reference to an arbitrary electrode, the pulse or impulse having a different peak value in accordance with the distance is applied to each of the electrodes to control a degree of change in status of the developer, whereby an image is formed onto the recording medium surface in a uniform or a desired status.

14. The image forming apparatus of claim 11, wherein when a distance between an electrode to which the pulse or impulse is to be applied and the holder or the developer held on the holder may be different with reference to an arbitrary electrode, the pulse or impulse having a different pulse width in accordance with the distance is applied to each of the electrodes to control a degree of change in status of the developer, whereby an image uniform or in a desired status is formed onto the recording medium surface.

15. The image forming apparatus of claim 11, wherein the control electrode further includes a single plate-like shielded electrode having openings corresponding to the plurality of gates of the insulated substrate, disposed on the holder side of the insulated substrate.

16. The image forming apparatus of claim 15, wherein the shielded electrode is divided into a plurality of parts at least in accordance with a distance from the holder or from the developer held on the surface of the holder, and the control circuit applies a pulse or impulse having a different peak value in accordance with the distance to each of the electrodes to control a degree of change in status of the developer, whereby an image uniform or in a desired status is formed onto the recording medium surface.

17. The image forming apparatus of claim 15, wherein the shielded electrode is divided into a plurality of parts at least in accordance with a distance from the holder or from the developer held on the surface of the holder, and the control circuit applies a pulse or impulse having a different pulse width in accordance with the distance to each of the electrodes to control a degree of change in status of the developer, whereby an image uniform or in a desired status is formed onto the recording medium surface.

* * * * *